US005613554A

United States Patent [19]

Bull et al.

[11] Patent Number: 5,613,554

[45] Date of Patent: Mar. 25, 1997

[54] A-COIL HEAT EXCHANGER

[75] Inventors: George B. Bull; James E. Carpenter, both of Grenada, Miss.

[73] Assignee: Heatcraft Inc., Grenada, Miss.

[21] Appl. No.: 494,363

[22] Filed: Jun. 23, 1995

[51] Int. Cl.[6] ..... F28D 1/053

[52] U.S. Cl. ..... 165/150; 165/122; 165/124; 165/126; 165/145; 165/151; 62/291

[58] Field of Search ..... 165/111, 110, 165/122, 150, 151, 144, 126, 145, 124; 62/285, 291

[56] References Cited

U.S. PATENT DOCUMENTS

| | | | |
|---|---|---|---|
| 3,212,288 | 10/1965 | Herbert | 62/290 |
| 4,337,823 | 7/1982 | DelPercio | 165/122 X |
| 4,429,734 | 2/1984 | Vandervaart | 165/124 X |
| 4,832,116 | 5/1989 | Easton | 165/126 |

FOREIGN PATENT DOCUMENTS

| | | | |
|---|---|---|---|
| 76833 | 4/1986 | Japan | 165/122 |
| 101639 | 5/1988 | Japan | 62/291 |

*Primary Examiner*—Leonard R. Leo
*Attorney, Agent, or Firm*—W. Kirk McCord

[57] ABSTRACT

A contoured A-coil heat exchanger is provided which enhances cooling capacity of the heat exchanger by increasing the volume rate of airflow therethrough. The two slabs of the A-coil each have discrete upper and lower sections, with the upper section of each slab having a greater number of rows of tubes than the lower section thereof, so that the lower section of each slab is narrower than the corresponding upper section. Therefore, the condensate collecting channel of a drain pan used with the heat exchanger can be made commensurately narrower because the channel need only be wide enough to accommodate the lower sections with fewer tube rows than the upper sections. The narrower channel allows the area of the drain pan central opening to be larger for a given size drain pan, thereby increasing the volume rate of airflow through the central opening and through the heat exchanger. The lower section of each slab preferably has sufficient height along a major dimension thereof to allow an axis projecting vertically downwardly from a lowermost portion of an outer side of each upper section to fall within the drain pan channel, so that condensation draining from the upper section of each slab is effectively captured.

6 Claims, 7 Drawing Sheets

A-COIL HEAT EXCHANGER

TECHNICAL FIELD

This invention relates generally to heat exchangers used in air conditioning and refrigeration applications and in particular to an improved heat exchanger of the A-coil type.

BACKGROUND ART

So-called tinned tube heat exchangers are widely used in a variety of applications in the fields of air conditioning, refrigeration and the like. Typically, such heat exchangers are comprised of plural rows of tubes in which a first heat transfer fluid, such as water, oil, air or a vapor compression refrigerant, flows while a second heat transfer fluid, such as air, is directed across the outside of the tubes. To improve heat transfer, a plurality of fins comprising thin sheets of metal are placed on the tubes. Each fin has multiple holes through which the tubes pass generally at right angles to the fins. The fins are arranged in parallel, closely spaced relationship along the tubes to form multiple paths for the second heat transfer fluid to flow across the fins and around the tubes.

One type of tinned tube heat exchanger is the so-called A-coil heat exchanger, which is comprised of two coil slabs coupled at their respective upper ends and diverging downwardly therefrom to define a generally "A" shape. Each slab typically has plural rows of heat transfer fluid carrying tubes in parallel array and plural fins through which the tubes are laced. The fins define inner and outer sides of each slab and a plurality of airflow passages between the corresponding inner and outer sides. The inner sides of the respective slabs are in generally facing relationship. The top, front and back of the heat exchanger are closed so that air to be cooled is constrained to flow outwardly through the slabs. Such A-coil heat exchangers are typically used as indoor heat exchangers and may be mounted above or below a furnace housing. The respective lower ends of the coil slabs are adapted to be received within a pan for collecting condensate drainage from the heat exchanger. The pan typically has a central opening positionable in registration with the closed top of the heat exchanger. Air to be cooled flows through the central opening into a region of the heat exchanger between the slabs and then outwardly through the slabs. The pan has a continuous channel for collecting condensate drainage from the heat exchanger. The channel should have sufficient width (along a minor dimension thereof) to accommodate the lower ends of the respective coil slabs. The greater the thickness of the slab (as measured between the inner and outer sides of the slab) the greater the width of the channel that is required to accommodate the lower end of the slab. Generally, the thickness of each slab is a function of the number of tube rows on the slab. The size of the drain pan usually depends on the width of the furnace housing with which the heat exchanger is mounted. For a given sized drain pan, the greater the width of the condensate collecting channel, the smaller will be the central opening in the drain pan.

DISCLOSURE OF INVENTION

In accordance with the present invention, an improved A-coil heat exchanger is provided. The heat exchanger is comprised of a pair of coil slabs, each having at least upper and lower sections, with the slabs being coupled at their respective upper sections and being in divergent relationship to define an A-coil configuration. The lower sections are adapted to be at least partially received within a condensate collector. Each of the slabs has a plurality of rows of heat transfer fluid carrying tubes in parallel array.

In accordance with a feature of the invention, a first selected one or more of the rows extends along both the upper and lower sections of each slab, while a second selected one or more of the rows extends only along the upper section of each slab, so that the second selected one or more of the rows is abbreviated with respect to the first selected one or more of the rows.

In accordance with another feature of the invention, each slab is contoured such that when the lower sections are at least partially received within a condensate collector, an axis projecting vertically downwardly from an outermost portion of each slab falls within an enclosure defined by the condensate collector.

In accordance with yet another feature of the invention, each slab has plural fins defining inner and outer sides of the corresponding slab and a plurality of airflow passages between the corresponding inner and outer sides. The inner sides are in generally facing relationship. The upper section of each slab is thicker than the lower section of the corresponding slab, as measured along an axis extending between the inner and outer sides of the corresponding slab.

In accordance with still another feature of the invention, the second selected one or more of the rows includes an outermost row of each slab, the outermost row of each slab being proximate to the outer side of the corresponding slab. The condensate collector is preferably a drain pan defining a continuous walled enclosure with a channel which is sufficiently wide to accommodate the lower sections. When the lower sections are at least partially received within the channel, an axis projecting vertically downwardly from a lowermost portion of the outer side of each upper section should fall within the channel, so that condensation which accumulates on the fins is able to drain downwardly into the pan.

In one embodiment of the invention, the first selected one or more of the rows includes first and second rows of each slab and the second selected one or more of the rows includes a third row of each slab. The third row of each slab is the outermost row of the corresponding slab and is abbreviated with respect to the first and second rows of the corresponding slab. The upper section of each slab has a thickness sufficient to accommodate three rows of tubes, while the lower section of each slab has a thickness sufficient to accommodate only two rows of tubes. Therefore, the drain pan channel need only be wide enough to accommodate the lower sections (i.e., two row thickness instead of three row thickness). The central opening in the drain pan can then be made larger than it would be if the channel had to accommodate a slab having a thickness of three tube rows, thereby commensurately increasing the volume rate of airflow through the heat exchanger.

In another embodiment of the invention, the first selected one or more of the rows includes first, second and third rows of each slab and the second selected one or more of the rows includes a fourth row of each slab, the fourth row being the outermost row of the corresponding slab and being abbreviated with respect to the first, second and third rows of the corresponding slab. In this embodiment, the upper section of each slab contains four rows of tubes, while the lower section thereof contains only three rows. The drain pan channel therefore has a width sufficient to accommodate the lower sections (i.e., three row thickness instead of four row thickness). This space saving feature allows the central opening in the drain pan to be made commensurately larger than it would be if the channel had to accommodate a slab having a thickness of four tube rows.

In accordance with the present invention, an improved A-coil heat exchanger is provided which enhances the cooling capacity of the heat exchanger by allowing a greater volume of airflow through the heat exchanger as compared to conventional A-coil heat exchangers. This is accomplished by contouring each of the coil slabs to define discrete upper and lower sections, with the upper section having a greater number of tube rows than the lower section so that the lower section of each slab is thinner than the upper section, as measured between the inner and outer sides of the slab. The condensate collecting channel of the drain pan used with the heat exchanger can then be made commensurately narrower because the channel need only be wide enough to accommodate the thickness of the lower sections. A narrower channel translates into a larger central opening for a given sized drain pan. The lower section of each slab should have sufficient length along a major axis of the corresponding slab extending between the upper and lower ends thereof such that an axis projecting vertically downwardly from the finned outer side of each upper section falls within the drain pan channel, to capture the condensate drainage from the upper sections.

BEST MODE FOR CARRYING OUT THE INVENTION

The best mode for carrying out the invention will now be described with reference to the accompanying drawings. Like parts are marked throughout the specification and drawings with the same respective reference numbers. The drawings are not necessarily to scale and in some instances proportions may have been exaggerated in order to better illustrate certain features of the invention.

Figure 1:
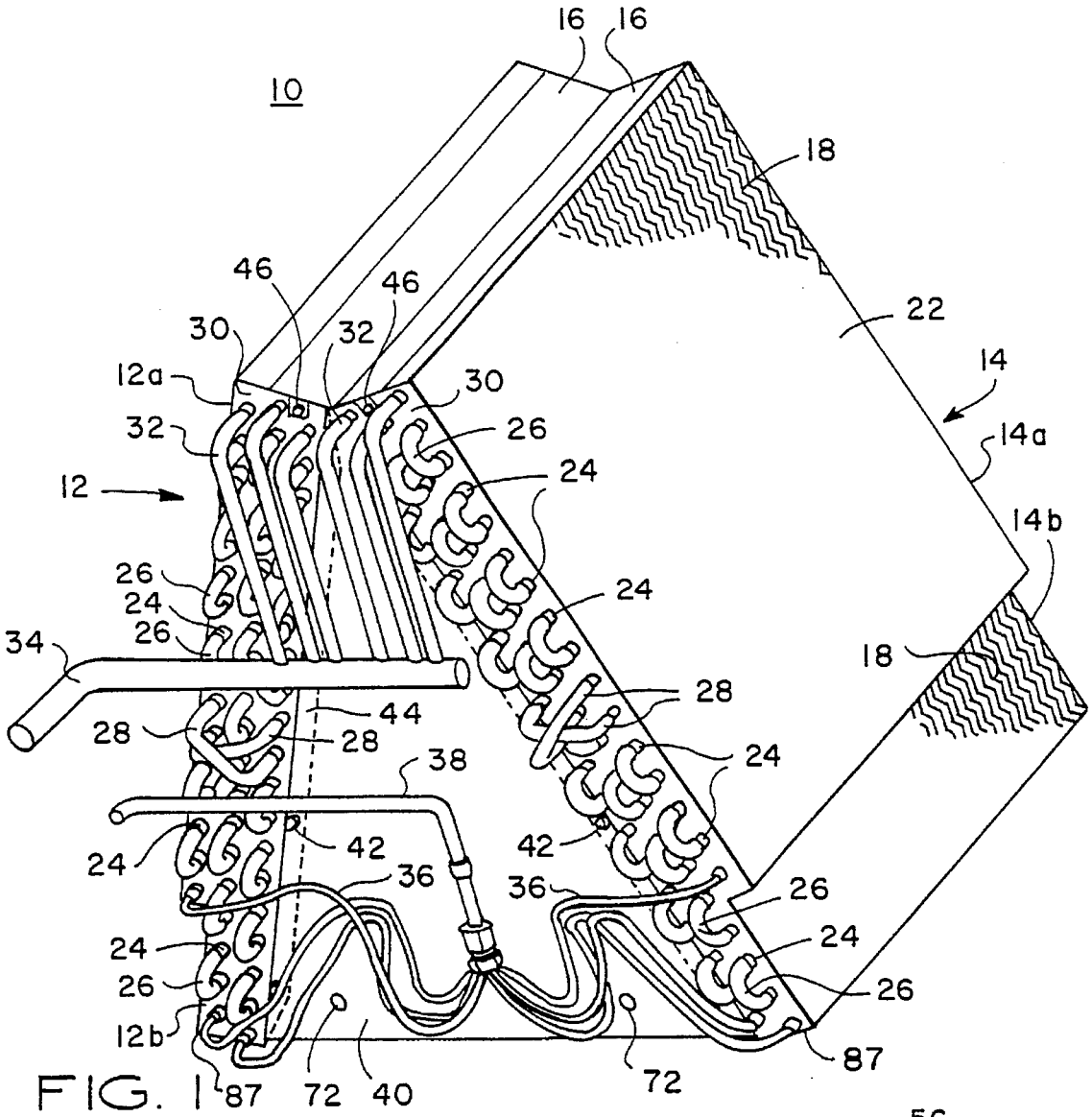
FIG. 1 is a perspective view of an improved A-coil heat exchanger, according to the present invention.
Figure 2:
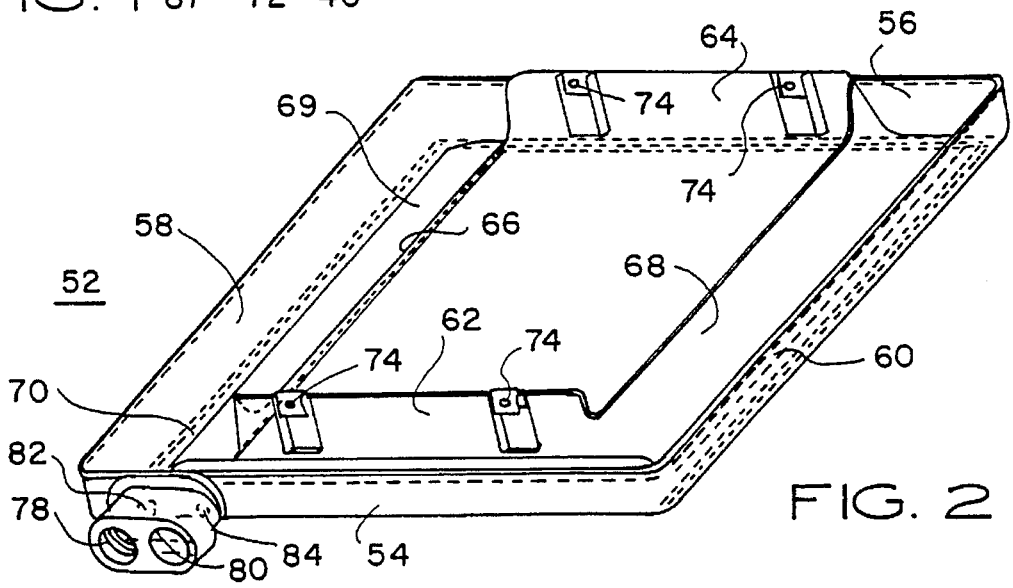
FIG. 2 is a perspective view of a drain pan of a type used to capture condensation emanating from the heat exchanger of FIG. 1.
Figure 3:
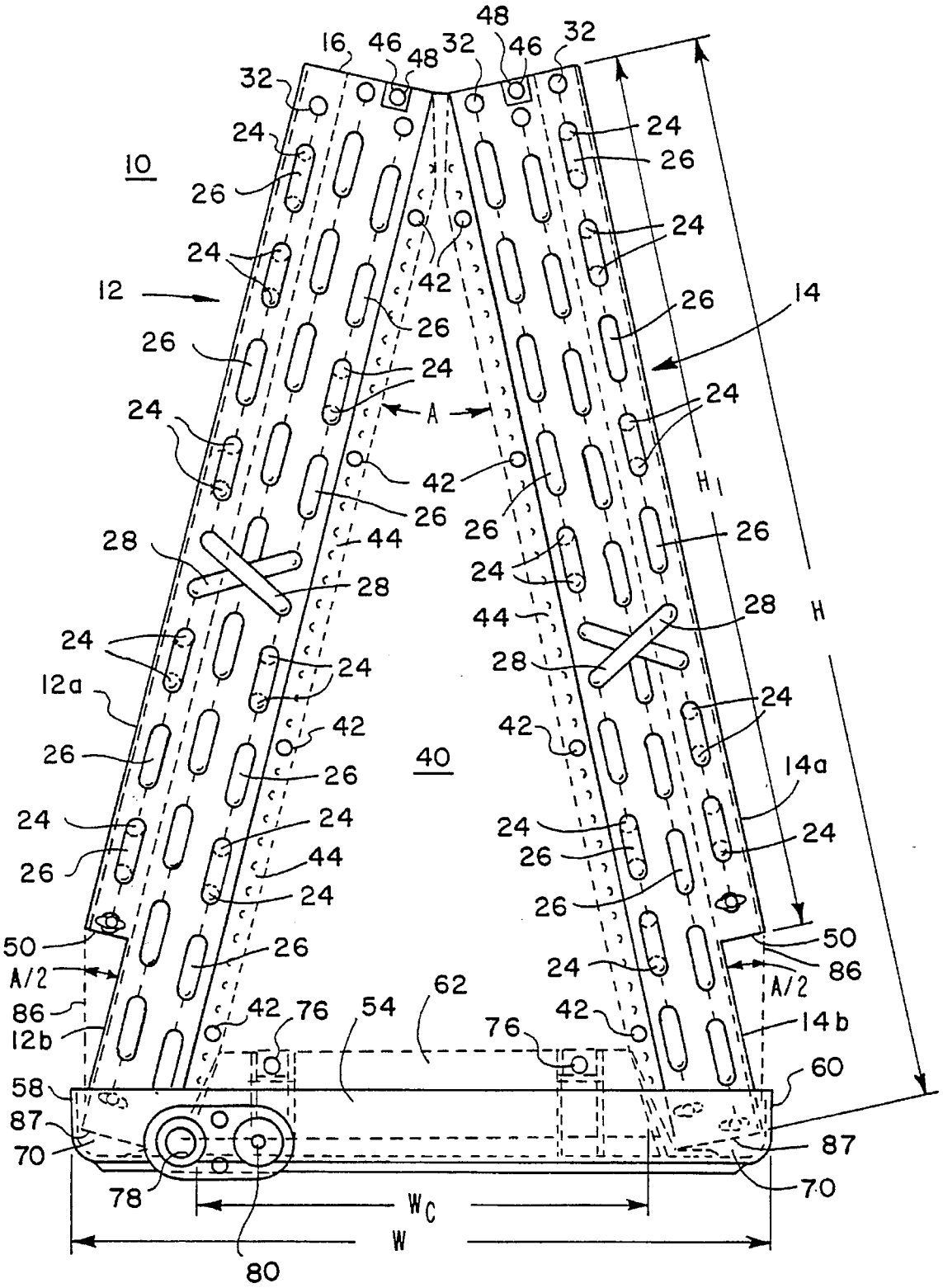
FIG. 3 is an elevation view of the heat exchanger of FIG. 1, with respective lower ends thereof received within a drain pan of the type shown in FIG. 2.

Referring to FIGS. 1–4, an A-coil heat exchanger 10 is comprised of a pair of coil slabs 12 and 14, which are coupled together at their respective upper ends by a top plate 16 and extend downwardly therefrom in divergent relationship to define an angle A therebetween. Top plate 16 defines the upper end of each slab 12, 14. Left slab 12 is contoured to define discrete upper and lower sections **12*a* and 12*b*, respectively. Right slab 14 is contoured to define discrete upper and lower sections 14*a* and 14*b*, respectively. Each slab 12, 14 has a plurality of fins 18 in parallel, closely spaced relationship. Fins define opposed inner and outer sides 20 and 22, respectively, of the corresponding slab 12, 14 and plural airflow passages between inner and outer sides 20 and 22 of each slab 12, 14. Each slab 12, 14 further includes three rows of heat transfer fluid (e.g., a vapor compression refrigerant) carrying tubes 24. Tubes 24 pass through respective openings in fins 18 and cooperate with fins 18 to form multiple paths for a second heat transfer fluid (e.g., air to be cooled) to flow through heat exchanger 10. Tubes 24 are preferably formed as hairpins with return bends 26 or jumper bends 28 connecting distal ends of respective tubes 24. Tubes 24 penetrate through header plates 30 on both the front and back of each slab 12, 14. Only the front header plates 30 are shown in FIGS. 1 and 3. The six tube rows (three rows on each slab 12, 14) define six discrete tube circuits, with each circuit comprising multiple passes through the corresponding slab 12, 14**.

Six adapter tubes 32 connect the outlets of the respective tube circuits to an outlet header 34 on the suction side of a compressor (not shown) when the heat transfer fluid is a vapor compression refrigerant. Six flexible distributor tubes 36 connect the inlets of the respective tube circuits to an inlet header 38 in fluid communication with the discharge side of the compressor. In operation, the heat transfer fluid (e.g., a vapor compression refrigerant) enters heat exchanger 10 through the six distributor tubes 36 in liquid form, makes multiple passes through heat exchanger 10 in each tube circuit, is substantially vaporized in heat exchanger 10 and exits heat exchanger 10 through the six adapter tubes 32. Air or other fluid to be cooled flows into a region of heat exchanger 10 between slabs 12 and 14. The air then flows outwardly through the tinned inner sides 20 and exits heat exchanger 10 through the tinned outer sides 22. The air is cooled as it flows outwardly through slabs 12 and 14. Triangular delta plates 40 are connected by means of attachment screws 42 to flanges 44 extending from respective header plates 30 into a region of heat exchanger 10 between slabs 12 and 14. Only the front delta plate 40 is shown in FIGS. 1 and 3. Delta plates 40 close off the front and back of heat exchanger 10 and top plate 16 closes off the top thereof so that air to be cooled flowing into heat exchanger 10 is constrained to flow outwardly through slabs 12 and 14.

Top plate 16 has a plurality of tabs 46 overlapping respective header plates 30 on both the front and back of heat exchanger 10. Attachment screws 48 extend through openings in respective tabs 46 to attach top plate 16 to front and back header plates 30 of each slab 12, 14, thereby coupling slabs 12 and 14 at their respective upper ends with inner sides 20 in facing relationship. Fins 18 are preferably comprised of a plurality of two-row fins, each having a height H extending substantially the entire height of the corresponding slab 12, 14, as measured along a major dimension of the corresponding slab 12, 14 between the upper and lower ends thereof and a plurality of one-row tins, each having a height $H_1$ extending substantially the entire height of upper section **12*a*, 14*a* of the corresponding slab 12, 14, as measured along a major dimension of the corresponding upper section 12***a*, 14*a* between the upper end of the corresponding slab 12, 14 and a position 50 intermediate the upper and lower ends of the corresponding slab 12, 14. Position 50 defines a boundary between upper section 12*a*, 14*a* and lower section 12*b*, 14*b* of the corresponding slab 12, 14.

A drain pan 52 for collecting condensate drainage from heat exchanger 10 has front and back outer walls 54 and 56, respectively, and opposed side outer walls 58 and 60, which define a continuous walled rectangular enclosure. Front and back inner walls 62 and 64, respectively, and opposed side inner walls 66 and 68 define a continuous channel 70 within the enclosure for collecting condensate drainage from heat exchanger 10. Pan 52 is positionable beneath heat exchanger 10 and is adapted to at least partially receive lower sections 12*b* and 14*b* within channel 70, as can be best seen in FIGS. 3 and 4. Side inner walls 66 and 68 are substantially lower than front and back inner walls 62 and 64, as can be seen in FIG. 2, to facilitate receiving lower sections 12*b* and 14*b*. A support base 69 extends around the inner walls 62, 64, 66 and 68 for supporting the lower ends of slabs 12 and 14. Drain pan 52 has a central opening 71 surrounded by inner walls 62, 64, 66 and 68.

Each delta plate 40 has a pair of openings 72 (FIG. 1) which are alignable with complementary openings in attachment clips 74, which overlap front and back inner walls 62 and 64. Two attachment screws 76 (FIG. 3) attach front delta plate 40 to dips 74 on front inner wall 62. Two other attachment screws (not shown) attach the back delta plate (not shown) to clips 74 on back inner wall 64, thereby securing heat exchanger 10 to drain pan 52. Main and auxiliary drain connections 78 and 80, respectively, are in fluid communication with respective holes 82 and 84 in front outer wall 54 for conducting condensate drainage from drain pan 52.

Figure 4:
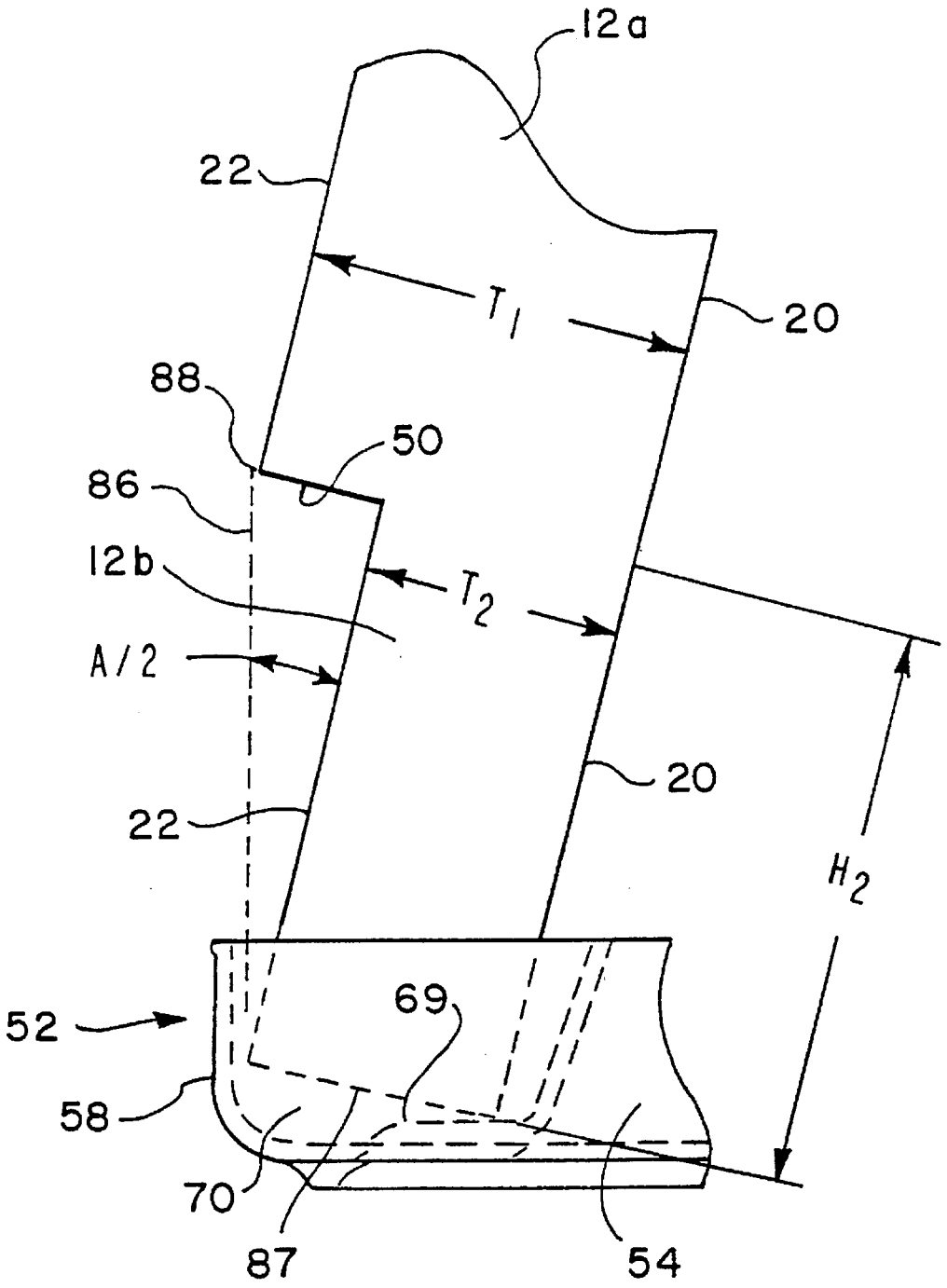
FIG. 4 is a detailed view of a lower portion of one slab of the heat exchanger of FIG. 1, received within a drain pan of the type shown in FIG. 2.

Referring specifically to FIGS. 3 and 4, the innermost row of each slab 12, 14 (i.e., the tube row proximate to inner side 20 of the corresponding slab 12, 14) and the middle row of each slab 12, 14 extend along both upper section 12*a*, 14*a* and the lower section 12*b*, 14*b* of the corresponding slab 12, 14, while the outermost row of each slab 12, 14 (i.e., the tube row proximate to the outer side 22 of the corresponding slab 12, 14) extends only along upper section 12*a*, 14*a* of the corresponding slab 12, 14, so that the outermost row of each slab 12, 14 is abbreviated with respect to the other two rows of the corresponding slab 12, 14. Therefore, when lower sections 12*b* and 14*b* are received within drain pan 52, channel 70 need be only wide enough to accommodate lower sections 12*b*, 14*b* containing two tube rows instead of three tube rows.

As shown in FIG. 4, each upper section 12*a*, 14*a* has a thickness $T_1$, as measured along a minor dimension thereof extending between the inner and outer sides 20 and 22 of the corresponding upper section 12*a*, 14*a*, while each lower section 12*b*, 14*b* has a thickness $T_2$, as measured along a minor dimension thereof extending between the inner and outer sides 20 and 22 of the corresponding lower section 12*b*, 14*b*. $T_1$ is greater than $T_2$. Lower section 12*b*, 14*b* of each slab 12, 14 has a height $H_2$, as measured along a major dimension of the corresponding lower section 12*b*, 14*b* between the lower end of the corresponding slab 12, 14 and intermediate position 50. Height $H_2$ is preferably sufficient to allow an axis 86 projecting vertically downwardly from a lowermost portion of the outer side of each upper section 12*a*, 14*a* (i.e., portion 88 in FIG. 4) to fall within channel 70, as shown in FIG. 4, so that condensation draining from any part of heat exchanger 10 is captured by drain pan 52. The relationship between $T_1$, $T_2$ and $H_2$ can be expressed as follows:

$$H_2 \geqq (T_1 - T_2) \text{ tangent } A/2$$

or $$T_1 - T_2 \leqq H_2 \text{ cotangent } A/2$$

As can be seen in FIGS. 3 and 4, $H_2 = H - H_1$. Height $H_2$ of each lower section 12*b*, 14*b* is measured from a lower end 87 of the corresponding slab 12, 14 to intermediate position 50. Height $H_1$ of each upper section 12*a*, 14*a* is measured from intermediate position 50 to the upper end (top plate 16) of the corresponding slab 12, 14.

By abbreviating the outermost row of each slab 12, 14 with respect to the innermost row and the middle row thereof, lower sections 12*b* and 14*b* are narrower than corresponding upper sections 12*a* and 14*a*, as measured between inner and outer sides 20 and 22. For example, if each upper section 12*a*, 14*a*, has a thickness $T_1$ and each lower section 12*b*, 14*b* has a thickness $T_2$, as shown in FIG. 4, channel 70 of drain pan 52 can be reduced in width by approximately $(T_1 - T_2)$ cosine A/2. Therefore, for a drain pan 52 having a width W (which depends on the width of the furnace housing with which heat exchanger 10 and drain pan 52 are mounted), as measured between side outer walls 58 and 60 (FIG. 3), the width Wc of central opening 71 depends on the width of each channel 70, which is approximately (W–Wc)/2. If each channel 70 is narrowed by an amount approximately equal to $(T_1 - T_2)$ cosine A/2 (the reduction in width allowed by a $T_1 - T_2$ difference in thickness between upper sections 12*a*, 14*a* and lower sections 12*b*, 14*b*), the area of central opening 71 can be increased by 2 $(T_1 - T_2)$ L cosine A/2, where L is the length of central opening 71, as measured between front and back inner walls 62 and 64. The volume rate of airflow through central opening 71 and therefore through heat exchanger 10 is directly proportional to the area of central opening 71.

Figure 5:
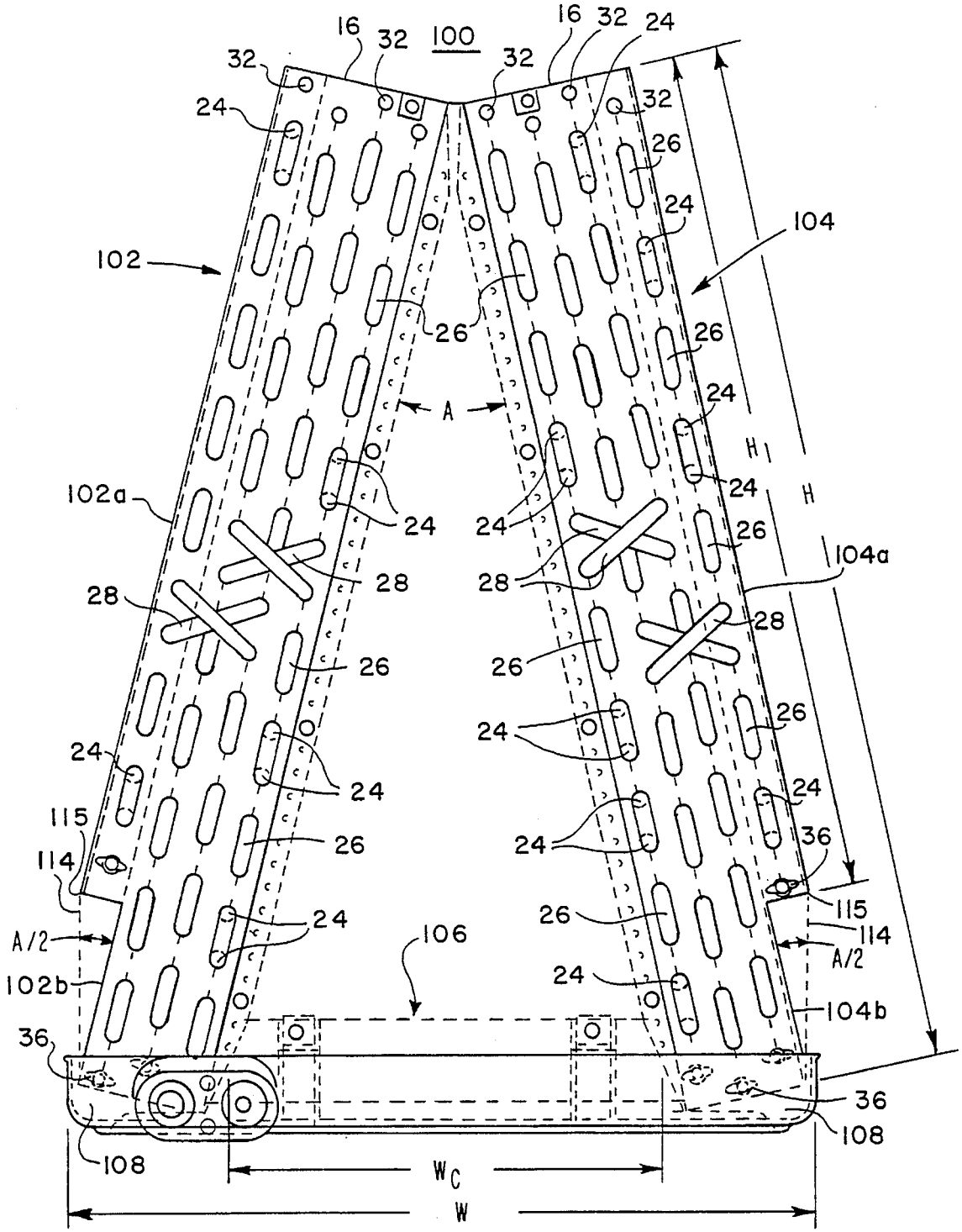
FIG. 5 is an elevation view of another embodiment of an A-coil heat exchanger, according to the present invention, with the lower ends thereof received within a drain pan of the type shown in FIG. 2.

Referring to FIGS. 4 and 5, another embodiment of an A-coil heat exchanger 100, according to the present invention, is illustrated. Heat exchanger 100 is substantially the same as heat exchanger 10, described hereinabove with reference to FIGS. 1–4, except that each slab 102, 104 of heat exchanger 100 has four rows of heat transfer fluid carrying tubes 24 in parallel array. Three of the four rows of each slab 102, 104 extend along both upper sections 102*a* and 104*a* and lower sections 102*b* and 104*b* of slabs 102 and 104, while a fourth row (the outermost row) extends only along upper sections 102*a* and 104*a*, so that the fourth row of each slab 102, 104 is abbreviated with respect to the other three rows of the corresponding slab 102, 104.

In this configuration, a drain pan 106 is provided with a continuous channel 108 for at least partially receiving respective lower sections 102*b* and 104*b*. Since lower sections 102*b* and 104*b* have a thickness $T_2$ (as measured along a minor dimension thereof between the finned inner and outer sides of respective slabs 102 and 104) sufficient to accommodate three tube rows, channel 108 of drain pan 106 must also be wide enough to accommodate three tube rows. Therefore, channel 108 is wider than channel 70, described hereinabove with reference to FIGS. 1–4. Each slab 102, 104 has two sets of fins. One set of fins having fin height H can accommodate three tube rows, while the other set of fins having a fin height $H_1$ is sized to accommodate one tube row (the outermost row). Height $H_2$ (FIG. 4) of each lower section 102*b*, 104*b* is preferably sufficient to allow an axis 114 projecting vertically downwardly from a lowermost portion 115 of the outer side of each upper section 102*a*, 104*a* to fall within channel 108 of drain pan 106 so that condensation draining from heat exchanger 100 is captured by drain pan 106.

Figure 6:
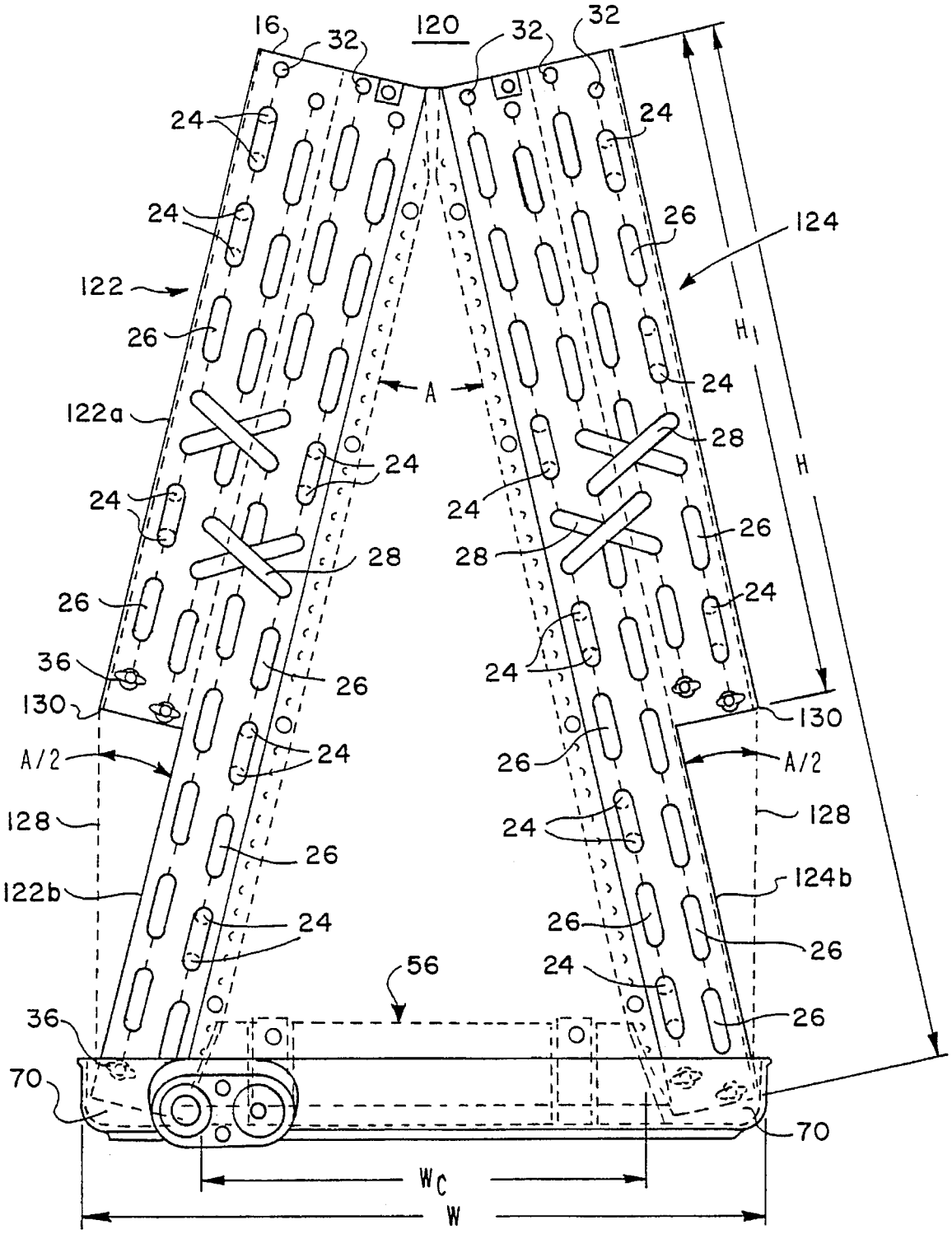
FIG. 6 is an elevation view of yet another embodiment of an A-coil heat exchanger, according to the present invention, with the lower ends thereof received within a drain pan of the type shown in FIG. 2.

Referring to FIGS. 4 and 6, yet another embodiment of an A-coil heat exchanger 120, according to the present invention, is illustrated. Heat exchanger 120 is substantially the same as heat exchanger 10, described hereinabove with reference to FIGS. 1–4, except that each slab 122, 124 has four rows of heat transfer fluid carrying tubes 24 in parallel array. The inner two rows of each slab 122, 124 extend along both an upper section 122*a*, 124*a* and a lower section 122*b*, 124*b* of the corresponding slab 122, 124. The outer two rows of each slab 122, 124 extend only along upper section 122*a*, 124*a* of the corresponding slab 122, 124, so that the outer two rows of each slab 122, 124 are abbreviated with respect to the inner two rows of the corresponding slab 122, 124.

Lower sections 122*b* and 124*b* are received within channel 70 of drain pan 56. Channel 70 is wide enough to accommodate a lower section 122*b*, 124*b* with its two rows of tubes 24. Height $H_2$ (FIG. 4) of each lower section 122*b*, 124*b* is preferably sufficient to allow an axis 128 projecting vertically downwardly from a lowermost portion 130 of the outer side of each upper section 122*a*, 124*a* to fall within channel 70, so that condensation draining from heat exchanger 120 is captured by drain pan 56. Because the difference in thickness ($T_1$–$T_2$) between upper section 122*a*, 124*a* and lower section 122*b*, 124*b* of each slab 122, 124 is greater than in heat exchanger 10, described hereinabove with reference to FIGS. 1–4, the corresponding height $H_2$ of each lower section 122*b*, 124*b* is greater than the height $H_2$ of each lower section 12*b*, 14*b* of heat exchanger 10. Each slab 122, 124 has two sets of fins. One set of fins having fin height H can accommodate two rows of tubes 24 (the inner two rows), while the other set of fins having fin height $H_1$ can accommodate two rows of tubes 24 (the two outer rows).

Figure 7:
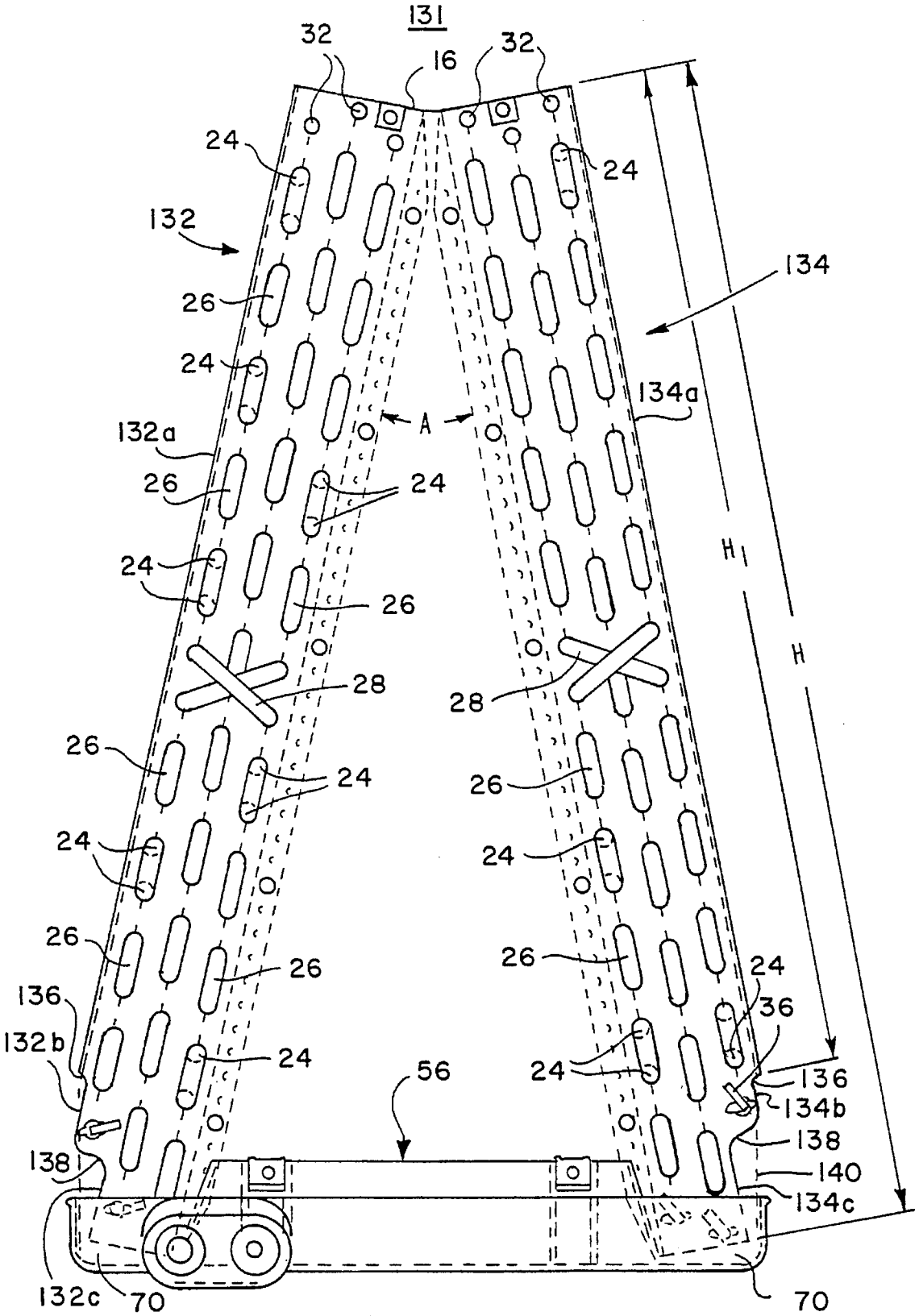
FIG. 7 is an elevation view of still another alternate embodiment of an A-coil heat exchanger, according to the present invention, with the lower ends thereof received within a drain pan of the type shown in FIG. 2.
Figure 8:
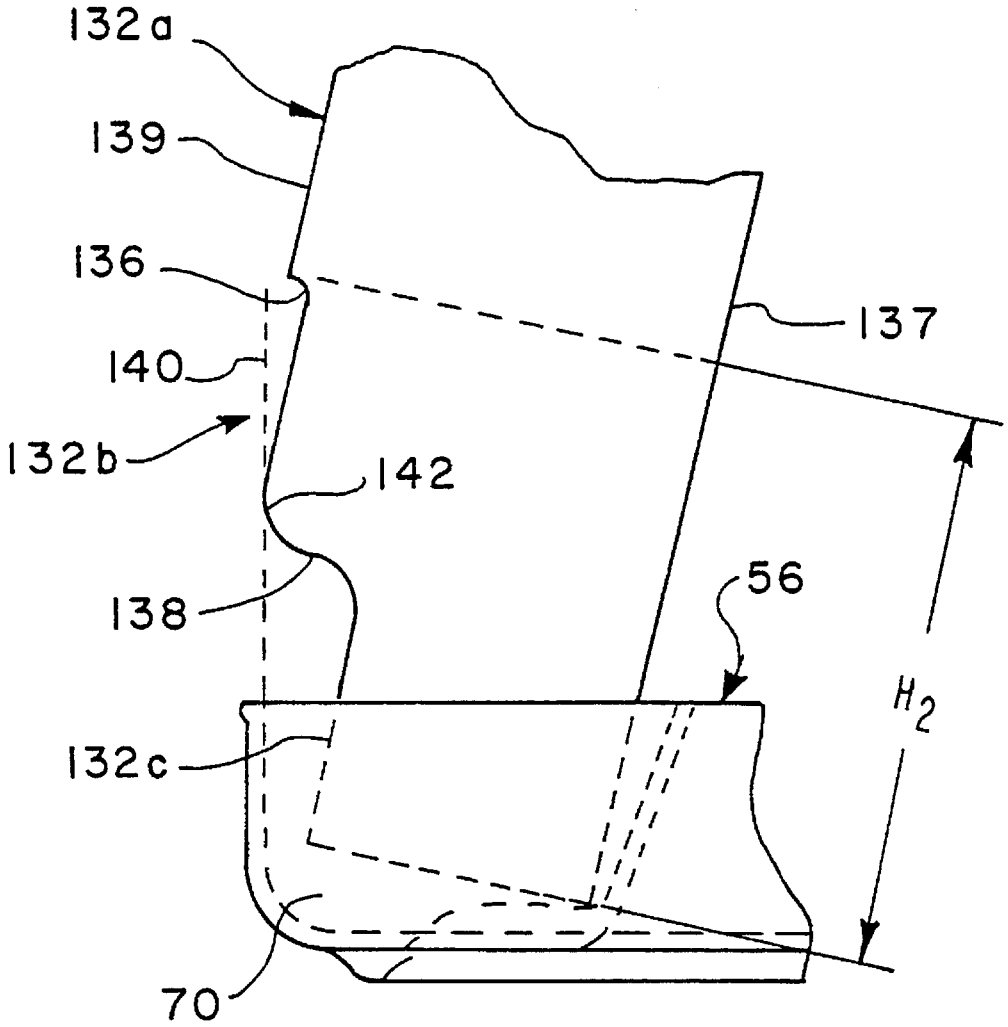
FIG. 8 is a detailed view of a lower portion of one slab of the heat exchanger of FIG. 7, received within a drain pan of the type shown in FIG. 2.

Referring to FIGS. 7 and 8, still another embodiment of an A-coil heat exchanger 131, according to the present invention, is illustrated. Heat exchanger 131 is substantially the same as heat exchanger 10, described hereinabove with reference to FIGS. 1–4, except that each slab 132, 134 is contoured to define three discrete sections (upper section 132*a*, intermediate section 132*b* and lower section 132*c* of slab 132 and upper section 134*a*, intermediate section 134*b* and lower section 134*c* of slab 134). Further, each slab 132, 134 has only one set of fins having a fin height H, which can accommodate three rows of tubes 24. The outer side of each slab 132, 134 is contoured by cutting the edges of the fins to define a first curved region 136 between each upper section 132*a*, 134*a* and the corresponding intermediate section 132*b*, 134*b* and a second curved region 138 between each intermediate section 132*b*, 134*b* and the corresponding lower section 132*c*, 134*c*. Each slab 132, 134 is contoured around the lowermost tube 24 and the distributor tube 36 of the outer tube row of the corresponding slab 132, 134. The inner two tube rows of each slab 132, 134 extend along substantially the entire height H of the corresponding slab 132, 134, while the outer tube row of each slab 132, 134 extends only along the upper section 132*a*, 134*a* and the intermediate section 132*b*, 134*b* of the corresponding slab 132, 134, so that the outer row of each slab 132, 134 is abbreviated with respect to the inner two rows of the corresponding slab 132, 134. Upper sections 132*a* and 134*a* are thicker than the corresponding intermediate sections 132*b* and 134*b* and intermediate sections 132*b* and 134*b* are thicker than the corresponding lower sections 132*c* and 134*c*, as measured between finned inner side 137 and finned outer side 139 of each slab 132, 134.

Lower sections 132*c* and 134*c* are received within channel 70 of drain pan 56. Channel 70 is wide enough to accommodate lower sections 132*c* and 134*c*, each with its two rows of tubes 24. Each upper section 132*a*, 134*a* has a height $H_1$. The combined height $H_2$ (FIG. 8) of the intermediate section 132*b*, 134*b* and the lower section 132*c*, 134*c* of each slab 132, 134 is preferably sufficient to allow an axis 140 projecting vertically downwardly from an outermost position on each slab 132, 134 (in this case, from an outermost position 142 on each intermediate section 132*b*, 134*b*) to fall within channel 70, so that condensation draining from heat exchanger 131 is effectively captured by drain pan 56.

In accordance with the present invention, an A-coil heat exchanger is contoured so that at least one row of tubes is abbreviated with respect to the other rows, thereby allowing a drain pan to be used which can accommodate fewer than the total number of tube rows, with the space saving being translated into a larger central opening in the drain pan, to enhance volume rate of airflow through the heat exchanger for greater cooling capacity. The contouring defines discrete upper and lower sections on each slab, with the upper section of each slab having a greater number of rows than the lower section thereof. Therefore, the lower section of each slab is thinner than the corresponding upper section because of fewer tube rows, so that the drain pan channel can be made commensurately narrower because only the narrower lower sections are received within the drain pan.

Various embodiments of the invention have now been described in detail. Since changes in or additions to the above-described embodiments may be made without departing from the nature, spirit or scope of the invention, the invention is not to be limited to said details, but only by the appended claims and their equivalents.

We claim:

1. A heat exchanger comprised of a pair of coil slabs, each slab having upper and lower ends, said slabs being coupled at their respective upper ends and being in divergent relationship to define an A-coil configuration with an angle A therebetween, each of said slabs having a plurality of rows of heat transfer fluid carrying tubes in parallel array, each slab having first and second sections, the first section of each slab extending from the upper end thereof to a position intermediate the upper and lower ends thereof, the second section of each slab extending from the intermediate position thereof to the lower end thereof, the first section of each slab having more rows than the second section thereof, each slab having a plurality of fins defining inner and outer sides of each slab and an airflow passage between the inner and outer sides of each slab, the inner sides of the slabs being in generally facing relationship, the first section of each slab being thicker than the second section, as measured between the inner and outer sides thereof, the first section of each slab having a thickness $T_1$, as measured between the inner and outer sides thereof, the second section of each slab having a thickness $T_2$, as measured between the inner and outer sides thereof, $T_1$ being greater than $T_2$, the first section of each slab having a height $H_1$, as measured between the upper end and the intermediate position of each slab, the second section of each slab having a height $H_2$, as measured between the intermediate position and the lower end of each slab, $T_1$–$T_2$ being less than or equal to $H_2$ multiplied by tangent A/2.

2. The heat exchanger of claim 1 wherein the first section of each slab has three rows of tubes and the second section of each slab has two rows of tubes.

3. The heat exchanger of claim 1 wherein the first section of each slab has four rows of tubes and the second section of each slab has three rows of tubes.

4. The heat exchanger of claim 1 wherein the first section of each slab has four rows of tubes and the second section of each slab has two rows of tubes.

5. In combination:

a condensate collector comprising a drain pan defining a continuous walled enclosure, said drain pan having opposed generally parallel channels;

a heat exchanger comprised of a pair of coil slabs, each slab having upper and lower sections, said slabs being coupled at their respective upper sections and being in divergent relationship to define an A-coil configuration with an angle A therebetween, said lower sections being at least partially received within respective channels, each of said slabs having a plurality of rows of heat transfer fluid carrying tubes in parallel array, a first selected one or more of said rows extending along both the upper and lower sections of each slab, a second selected one or more of said rows extending along only the upper section of each slab so that the upper section of each slab has more rows of tubes than the lower section of each slab, each slab having a plurality of fins defining inner and outer sides of each slab and an airflow passage between the inner and outer sides thereof, said respective inner sides of the slabs being in generally facing relationship, each channel having a predetermined length along a major axis thereof and a predetermined width along a minor axis thereof, the upper section of each slab having a thickness $T_1$, as measured between the inner and outer sides thereof, the lower section of each slab having a thickness $T_2$, as measured between the inner and outer sides thereof, $T_1$ being greater than $T_2$, the upper section of each slab having a height $H_1$, as measured along a major axis thereof, the lower section of each slab having a height $H_2$, as measured along a major axis thereof, $H_2$ being greater than or equal to $(T_1-T_2)$ multiplied by cotangent A/2.

6. In combination:

a condensate collector having a drain pan defining a continuous walled enclosure, said drain pan having opposed generally parallel channels, each channel having a predetermined length along a major axis thereof and a predetermined width along a minor axis thereof; and a heat exchanger comprised of a pair of coil slabs, each slab having upper and lower sections, said slabs being coupled at their respective upper sections and being in divergent relationship to define an A-coil configuration with an angle A therebetween, said lower sections being at least partially received within said condensate collector, each of said slabs having a plurality of rows of heat transfer fluid carrying tubes in parallel array, a first selected one or more of said rows extending along both the upper and lower sections of each slab, a second selected one or more of said rows extending along only the upper section of each slab so that the upper section of each slab has more rows of tubes than the lower section of each slab, each slab being contoured such that an axis projecting vertically downwardly from an outermost portion of each upper section falls within said enclosure, said lower sections being at least partially received within respective channels, each slab having a plurality of fins defining inner and outer sides of each slab and an airflow passage between the inner and outer sides thereof, said inner sides being in generally facing relationship, an axis projecting vertically downwardly from a lowermost portion of the outer side of each upper section falling within a corresponding channel of said drain pan, the width of each channel being sufficient to accommodate a bottom portion of the lower section of one of the slabs, the upper section of each slab having a thickness $T_1$, as measured between the inner and outer sides thereof, the lower section of each slab having a thickness $T_2$, as measured between the inner and outer sides thereof, $T_1$ being greater than $T_2$, the upper section of each slab having a height $H_1$, as measured along a major axis thereof, the lower section of each slab having a height $H_2$, as measured along a major axis thereof, $H_2$ being greater than or equal to $(T_1-T_2)$ multiplied by cotangent A/2.

* * * * *